US005403255A

United States Patent [19]

Johnston

[11] Patent Number: 5,403,255

[45] Date of Patent: Apr. 4, 1995

[54] STATIONARY EXERCISING APPARATUS

[76] Inventor: Gary L. Johnston, P.O. Box 183, Cowarts, Ala. 36321

[21] Appl. No.: 970,168

[22] Filed: Nov. 2, 1992

[51] Int. Cl.[6] ..... A63B 21/00

[52] U.S. Cl. ..... 482/57; 482/51

[58] Field of Search ..... 482/57, 51, 148; 601/23, 27, 34–36

[56] References Cited

U.S. PATENT DOCUMENTS

| | | | |
|---|---|---|---|
| 4,632,386 | 12/1986 | Beech | 482/57 |
| 4,643,419 | 2/1987 | Hyde | 482/57 |
| 4,779,863 | 10/1988 | Yang | 482/57 |
| 4,786,050 | 11/1988 | Geschwender | 482/57 |

*Primary Examiner*—Stephen R. Crow
*Attorney, Agent, or Firm*—Richard C. Litman

[57] ABSTRACT

A stationary exercise apparatus is provided which a user operates while in a standing position. The apparatus includes a rotational assembly mounted on a frame structure. The rotational assembly includes a plurality of rotational members connected together by a closed loop. Cranks are attached to and extend from each side of each rotational member. A pedal is located on each side which bridges the cranks on that side. The cranks are arranged such that the pedals are opposingly positioned and travel their path of rotation while remaining in a horizontal position. Handles and optional variable resistance provide adjustable support and multiple work levels for the user.

6 Claims, 12 Drawing Sheets

STATIONARY EXERCISING APPARATUS

BACKGROUND OF THE INVENTION

This invention relates to an lower body exercise device and in particular to a stationary device which has an upright structure which allows the user to perform pedaling routines while in a standing position. This feature allows for a more overall lower body workout than provided by the more conventional, stationary, lower body exercise devices such as cycles, treadmills, stair-stepper devices, and skiing or glider devices.

As may be seen, there already exists many variations of stationary, upright lower body exercise devices. While these units offer a relatively good exercise, they all appear to be one dimensional. Most current cycling devices utilize a seat means, and those that do allow for pedaling while in a standing position are not very easy to operate due to difficulties with the user keeping their balance. Also, current stair-stepper execise devices and glider or skiing exercise devices do not provide as much rotary motion in the hips and stomach of the user as this improved pedaling apparatus does. Stair-stepper devices utilize upward and downward motion of the user while skiing or glider exercise devices utilize forward and backward motion. Treadmills do provide for more rotary motion of the hips and stomach, but force is exerted on the user only as the user steps on the treadmill base. This new pedaling device provides forces against the user during upward, downward, forward, and backward leg motion. Given the fact that there are vast numbers of pedaling 3exercise devices, it comes as a surprise that no one has effectively designed a pedaling device which provides for easy user interface while in a standing position.

SUMMARY AND OBJECTS OF THE INVENTION

It is the object of this invention to provide a pedaling device which is comfortable to operate and easy to use by the user while in an upright position. One version allows for manual device operation, with rotational motion in a rotation assembly being supplied by the user, while the other version allows for automatic device operation, with a motor being utilized to induce this motion. Both of these features will allow for a more complete lower body workout than provided by more conventional type lower body exercise devices.

It is the further object of this invention to provide an upright stationary exercise device which is adjustable to various user heigths and arm length, and which is collapseable into a more compact configuration and has the necessary wheel attachments for easy storage, transport, and relocation.

Also an object of this invention is to provide an upper body workout means operating in conjunction with the lower body cycling device. This greatly increases the capabilities of the overall apparatus.

Briefly stated, the apparatus that forms the basis of the present invention comprises a frame structure means, a rotation assembly means, and a foot engagement means. In one version, a resistance means may be part of the apparatus for manual device operation, while in the second version, a motor means may be used instead for automatic device operation.

The frame structure means includes a frame base upon which a rotation assembly means mounts and an upwardly extending handle member which assist the user in maintaining proper balance while operating the device. The rotation assembly means includes at least two rotatable members, both rotating simulataneously and in the same direction, with the same velocity and/or acceleration, due to an interconnection means. Connected to the rotation assembly means is a foot engagement means for user interface. The connection between the foot engagement means and the rotation assembly means is such that the foot engaging member of the foot engagement means will remain in a substantially horizontal position, at all times. This enables the user to maintain better balance during device operation. All other devices which utilize a foot engaging member do not have this feature. The apparatus dues not require a handle member, but it may prove useful in assisting the user in maintaining proper balance. Also the rotation assembly means may be constructed to operate in the forward or reverse rotational direction.

In the first version of the exercise device, manual operation of the device is utilized. The rotation assembly means is connected to a resistance means, also located on the frame base. Motion is produced in the foot engagement means by the user, which produces motion in the rotation assembly means. Since the resistance means is connected to the rotation assembly means, a resistance to motion in the foot engagement means is therefore produced.

In the second version, a motor means is connected to the rotation assembly means for automatic operation of the device. The motor means is used to produce motion in the rotation assembly means, which therefore produces motion in the foot engagement means. The foot engagement means thus creates movement in the lower body of the user, thereby also exercising lower body muscle groups.

The apparatus may be configureable for different operating capabilities. The frame structure means is designed to be configureable for different user leg and arm lengths. Also, the foot engagement means may be designed to allow for adjustable dimension of path motion and for adjustable user stance positions.

The apparatus also may be collapseable into a more compact configuration by repositioning the handle member to reduce overall device heigth. Also included on the frame structure means may be a wheel assembly, which along with the compact configuration, allows the apparatus to be more easily transported and stored.

An upper body workout means may also be part of the apparatus. It consist of two handle members which move in a forward and backward rocking motion, opposite to each other, as motion occurrs in the rotation assembly means. This type of upper body workout means is currently being used with many other lower body exercise devices.

Also, a typical exercise computer may be part of the apparatus. It is not shown in the accompanying figures, but may be connected to the device to keep track of exercise related data such as speed, mileage, time, calories, etc.

Other objects, features, and advantages for this invention will be apparent from the following detailed description and the appended claims, references being made to the accompanying drawings forming a part of the specification, wherein like reference numerals designate corresponding parts of the several views.

DETAILED DESCRIPTION OF THE PREFERRED EMBODIMENT

Before explaining in detail the present invention, it is to be understood that the invention is not limited in its application to the details of construction and arrangement of parts illustrated in the accompanying drawings, since the invention is capable of other embodiments and of being practiced or carried out in various ways. Also it is to be understood that the phraseology and terminology employed herein is for the purpose of description, and not limitation.

Figure 1A:
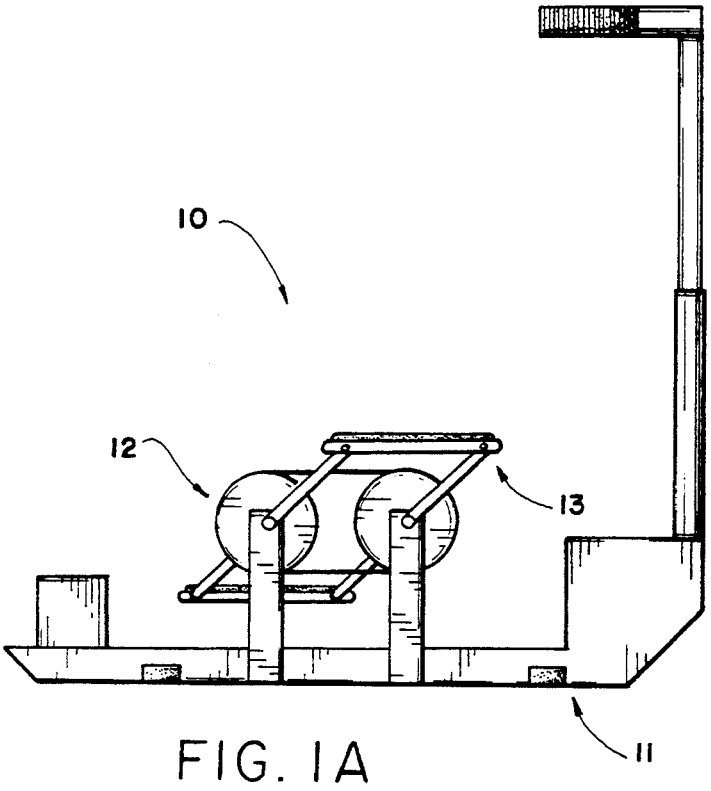
FIG. 1A is a side view of the stationary exercise apparatus.
Figure 1C:
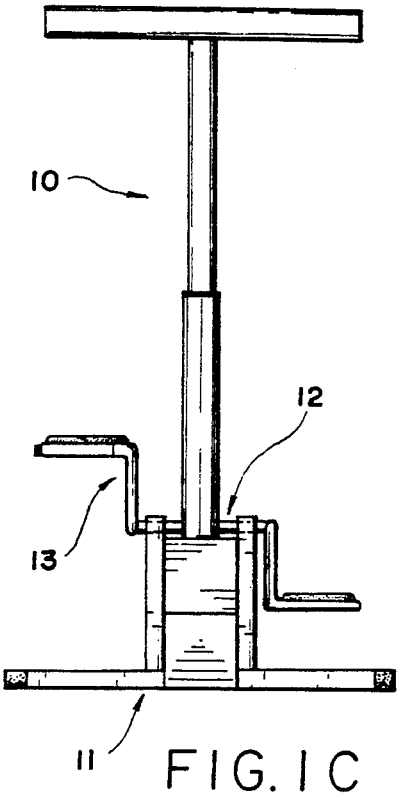
FIG. 1C is a front view of the exercise apparatus.
Figure 1B:
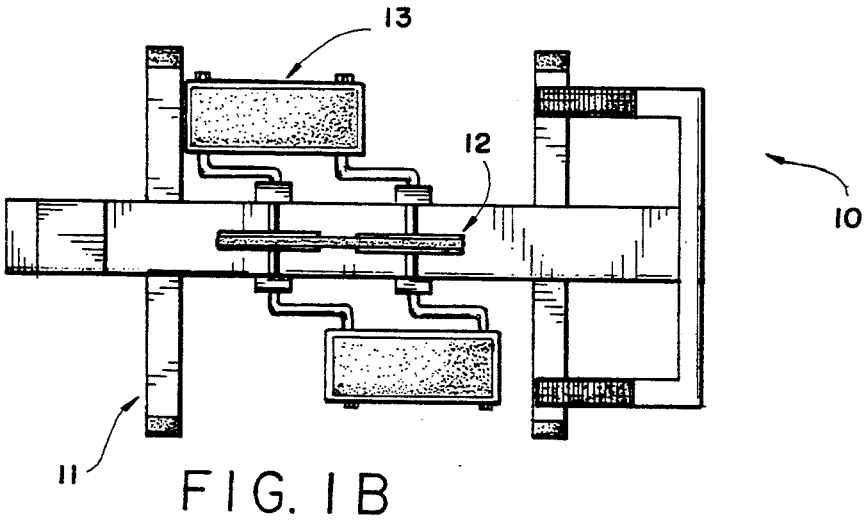
FIG. 1B is a top view of the exercise apparatus.

As best can be seen by references to the drawings, and in particular to FIGS. 1A thru 1C, the stationary exercise apparatus that forms the basis of the present invention is designated generally by the reference numeral 10. Stationary exercise apparatus 10 comprises a frame structure means 11, a rotation assembly means 12, and a foot engagement means 13.

Figure 1D:
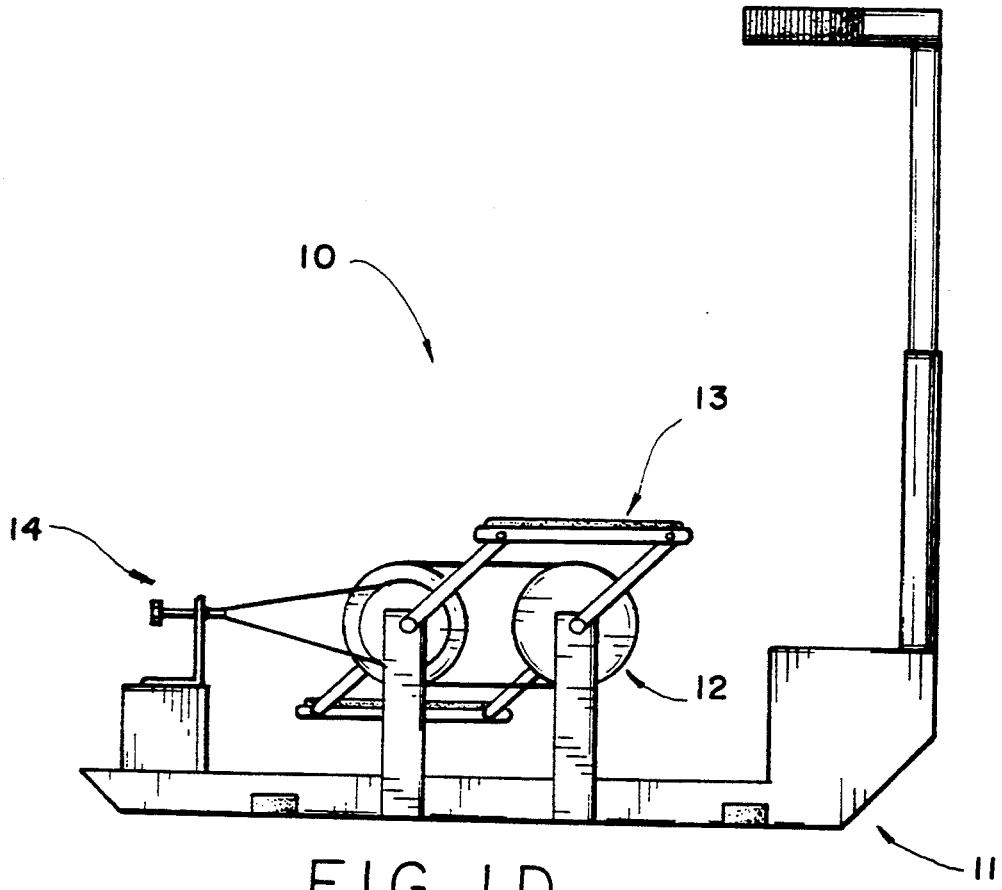
FIG. 1D is a side view of the exercise apparatus utilizing a resistance means.
Figure 1E:
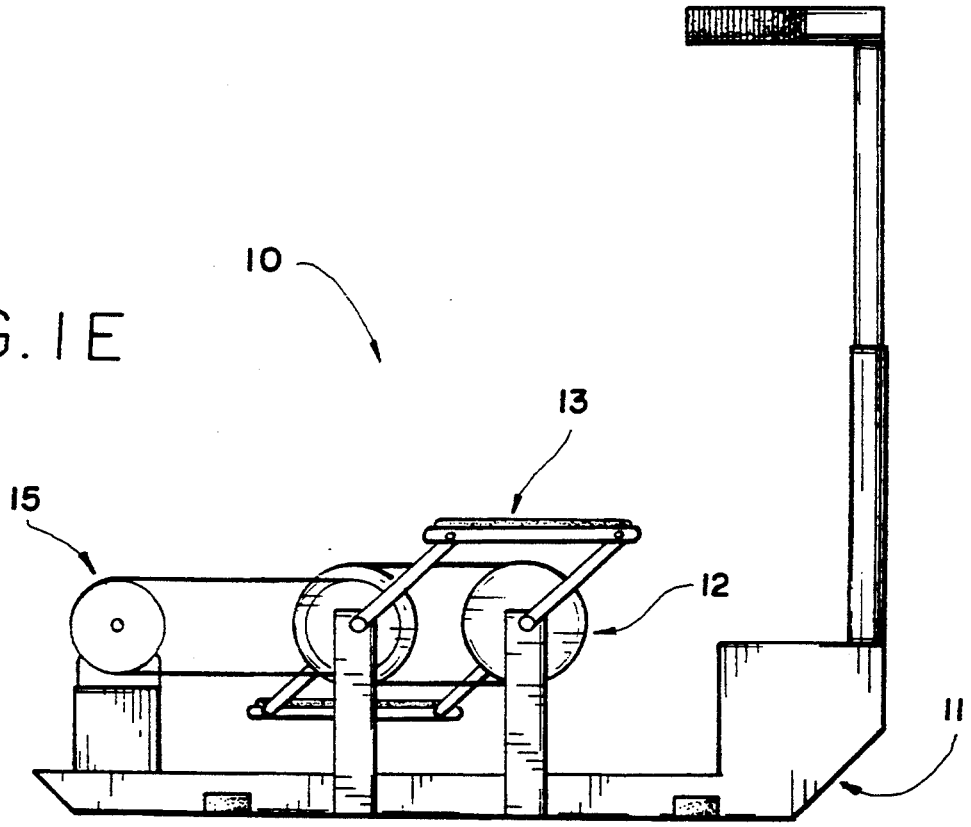
FIG. 1E is a side view of the exercise apparatus utilizing a motor means.

As further shown in FIGS. 1D and 1E, additional features may be part the apparatus. In FIG. 1D, the device utilizes a resistance means 14 to provide a resistance of motion during manual operation of the device. Since motion is induced by the user through the foot engagement means 13, this feature allows the user to vary how strenuous the exercising will be. FIG. 1E demonstrates the apparatus using a motor means 15 to induce motion in foot engagement means 13, for automatic operation of the device. This feature would be used by someone desiring a light, less strenuous workout routine.

Figure 2A:
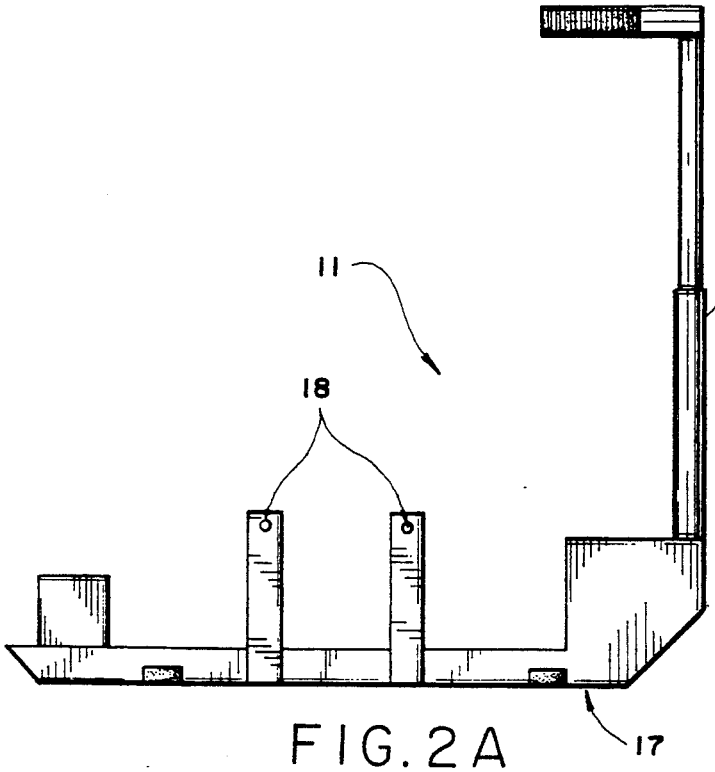
FIG. 2A is a side view of the frame structure means.
Figure 2C:
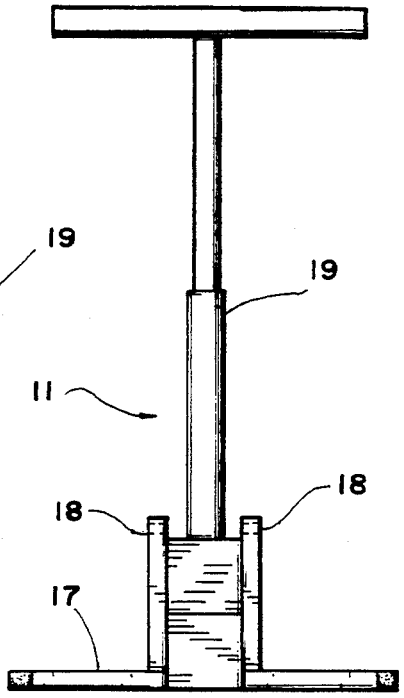
FIG. 2C is a front view of the frame structure means.
Figure 2B:
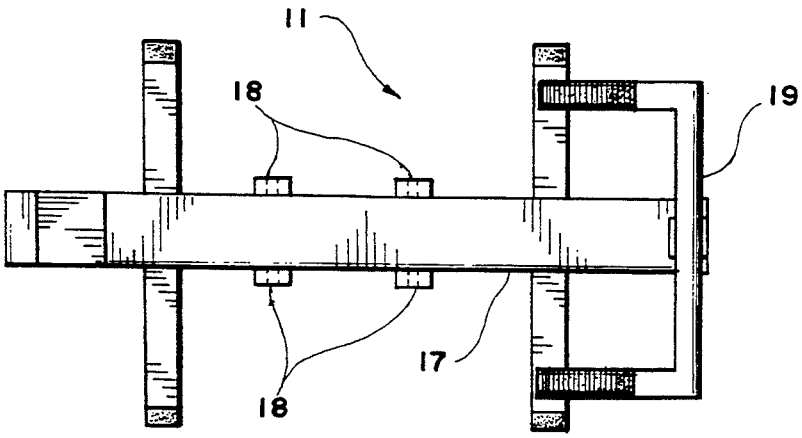
FIG. 2B is a top view of the frame structure means.
Figure 2D:
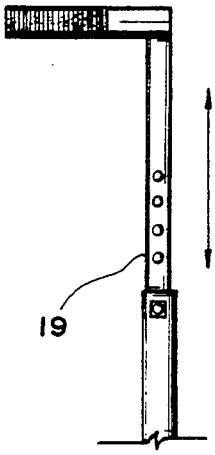
FIG. 2D is a side view of the frame structure means demonstrating a handle member which adjust for various user heigths.
Figure 2E:
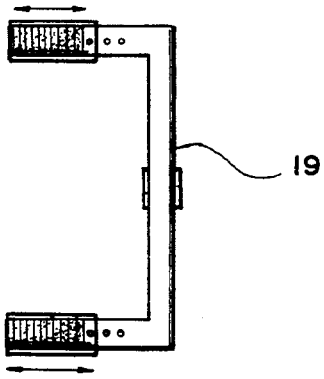
FIG. 2E is a top view of the frame structure means demonstrating a handle member which adjusts for various user arm lengths.

Referring to FIGS. 2A, 2B, and 2C, frame structure means 11 comprises a base structure 17, structure openings 18, and a handle member 19. The base structure 17 is used to support rotation assembly means 12 and the aforementioned additional features, resistance means 14 and motor means 15. Handle member 19 is used by the user in maintaining proper balance during operation of the device. As shown in FIG. 2D and 2E, handle member 19 may be adjusted to compensate for different heigths and arm lengths of various users.

Figure 3A:
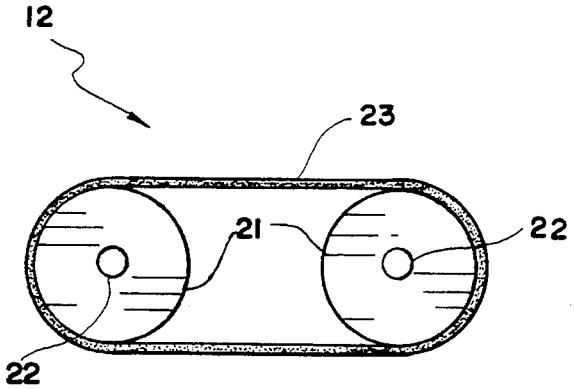
FIG. 3A is a side view of the rotation assembly means.
Figure 3C:
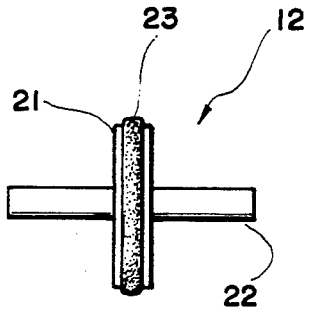
FIG. 3C is a front view of the rotation assembly means demonstrated in FIG. 3A.
Figure 3B:
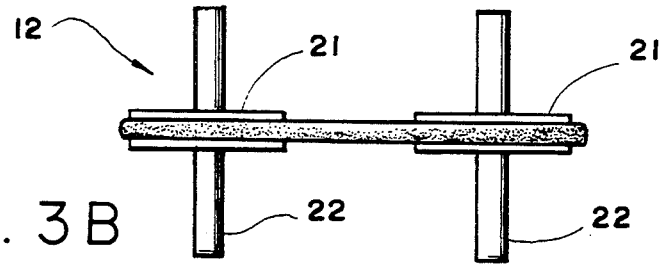
FIG. 3B is a top view of the rotation assembly means demonstrated in FIG. 3A.

As may be seen in FIGS. 3A–3C, rotation assembly means 12 comprises at least two rotatable members 21, connected by a closed loop interconnection member 23. Each rotatable member 21 is fixedly mounted on a shaft member 22, which connects the rotation assembly means 12 with base structure 17 through structure openings 18. Because of interconnection member 23, rotatable members 21 will rotate in the same direction. In order for the apparatus to operate as intended, the rotatable members 21 must rotate at the same angular velocity and/or acceleration. The simplest and best way to insure this is to have the rotatable members 21 be identical in construction and dimension, although other configurations may be utilized.

Rotation assembly means 12 is a typical drive train setup. Types of drives trains such as sprockets and chains, pulleys and belts, gears and drive shafts, rollers and belts, etc., may be used to form this assembly. This specification will demonstrate a sprocket and chain system for this and other rotatable systems to be mentioned, but it is not meant to be a limiting factor.

Figure 3D:
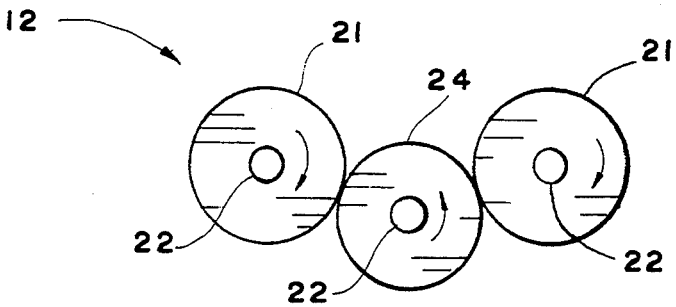
FIG. 3D is a side view of another version of the rotation assembly means.

FIG. 3D demonstrates another version of the rotation assembly means 12. At least two rotatable members 21 are this time connected by an intermediate rotatable member 24, with this intermediate rotatable member 24 being similar in structure to the rotatable members 21. This intermediate rotating member 24 would mount similarly on base structure 17 and would be in rotating contact with the rotatable members 21. It causes the rotatable members 21 to rotate in the same direction, at the same angular velocity and/or acceleration, again as long as the rotatable members 21 are identical in construction and dimension.

This version of rotational assembly means 16 is a typical gear-type assembly. Some examples are rotating gears with interfacing teeth, roller members with gripping surfaces, such as rubber, etc., where no slippage occurs as the members turn together.

Figure 4A:
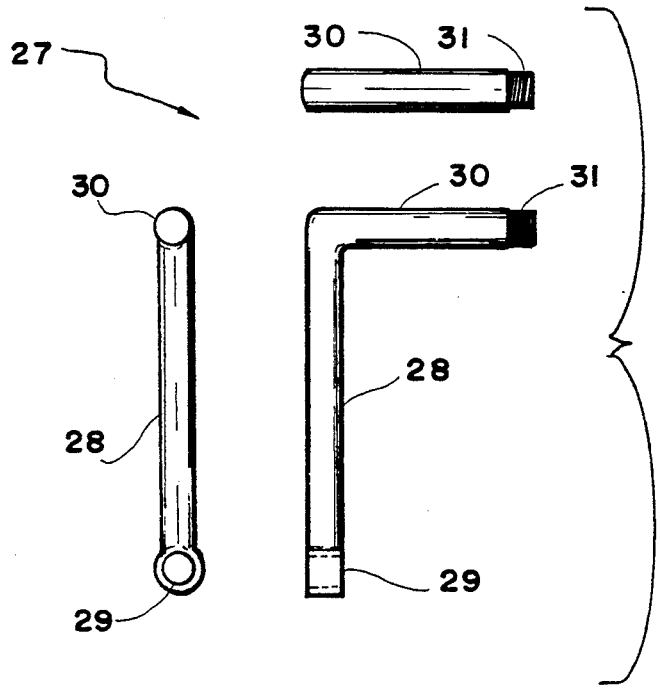
FIG. 4A is a side, front, and top view of the connection member of the foot engagement means.
Figure 4C:
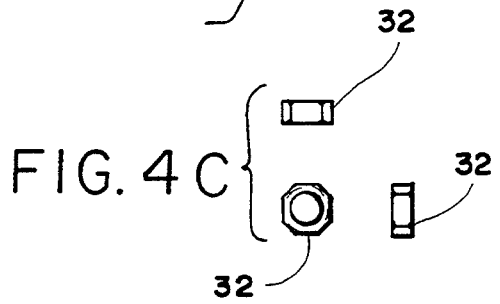
FIG. 4C is a side, front, and top view of the bolt nut member of the foot engagement means.
Figure 4B:
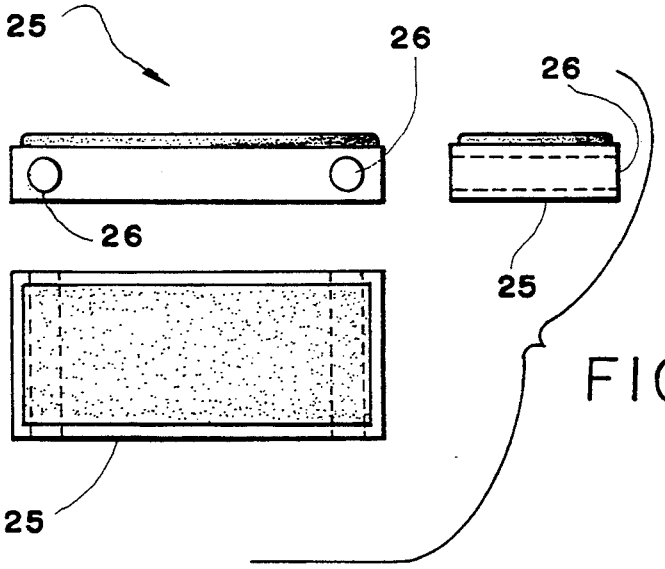
FIG. 4B is a side, front, and top view of the foot engaging member of the foot engagement means.

As shown in FIGS. 4A thru 4C, foot engagement means 13 is composed of at least two foot engaging members 25 and the required connection members 27. The connection members 27 are generally L-shaped rod elements with first and second legs, 28 and 30 respectively. The angle between the first leg 28 and second leg 30 does not have to be ninety degrees, but this would be the better angle. At the end of the first leg 28 is shaft opening 29 which receives shaft member 22 of rotation assembly means 12. Connection member 27 may be fixedly coupled to shaft member 22 by a weld, bolt, or the like, so that shaft member 22 and connection member 27 rotate together. It would be possible for the shaft and related connection members to be one continuous member, instead of separate components as demonstrated. Second leg 30 has a threaded end 31 so bolt nut member 32, or the like, may be attached to keep the foot engaging member 25 in place. Foot engaging members 25 is a relatively flat structure upon which the user places their foot. It also has tubular openings 26 through the side to loosely receive second legs 30 of connection members 27.

Figure 4D:
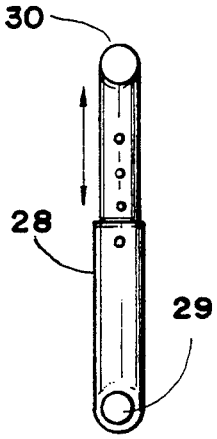
FIG. 4D is a side view demonstrating an adjustability feature of the connection member of the foot engagement means for adjusting the dimension of the rotation path.
Figure 4F:
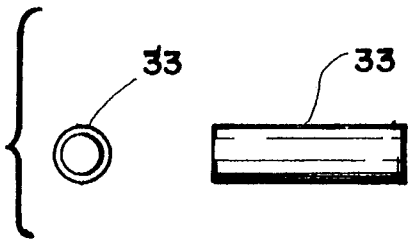
FIG. 4F is a top, front, and side view of a spacer which may be used when varying the width of user stance.
Figure 4E:
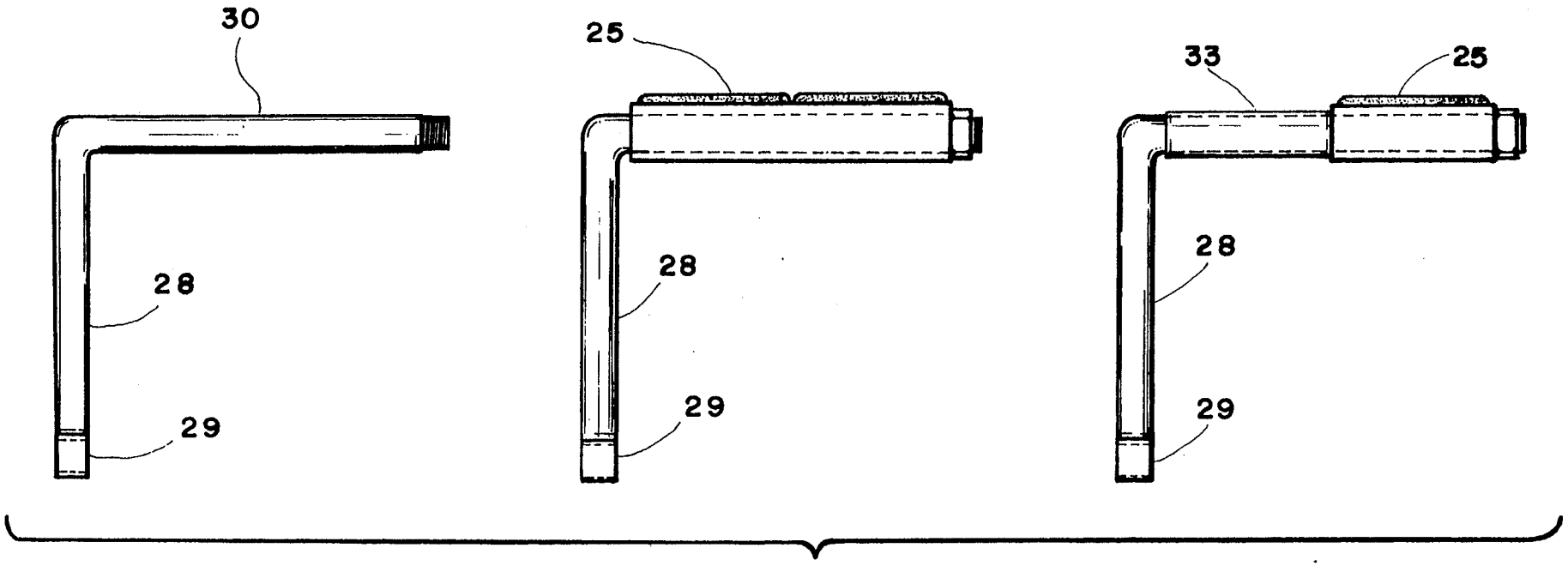
FIG. 4E is a side view demonstrating an adjustability feature of the foot engaging member of the foot engagement means for adjusting the width of the user stance.

As shown in FIG. 4D, first leg 28 may have an adjustability feature to increase and/or decrease its length. Shown is a typical telescoping structure which may be secured at different lengths. This would adjust the path of rotation for the foot engagement means. FIG. 4E shows an adjustability feature of the foot engagement means for varying the width of the user stance. Second leg 30 may be long enough to support a wider foot engaging member 25, wide enough so the user may place their feet at different widths. FIG. 4F demonstrates another method for varying the width of user stance. A spacer 33 may be placed between the foot engaging member 25 and first leg 28, so the foot engaging member 25 may be secured at a wider position. The positions may be reversed, with spacer 33 being placed on the outside, with foot engaging member 25 next to first leg 28, to allow for a narrower user stance. May other versions of this adjustability feature, including a telescoping feature in second leg 30 similar to first leg 28, exists and those shown are intended as examples only.

Figure 5:
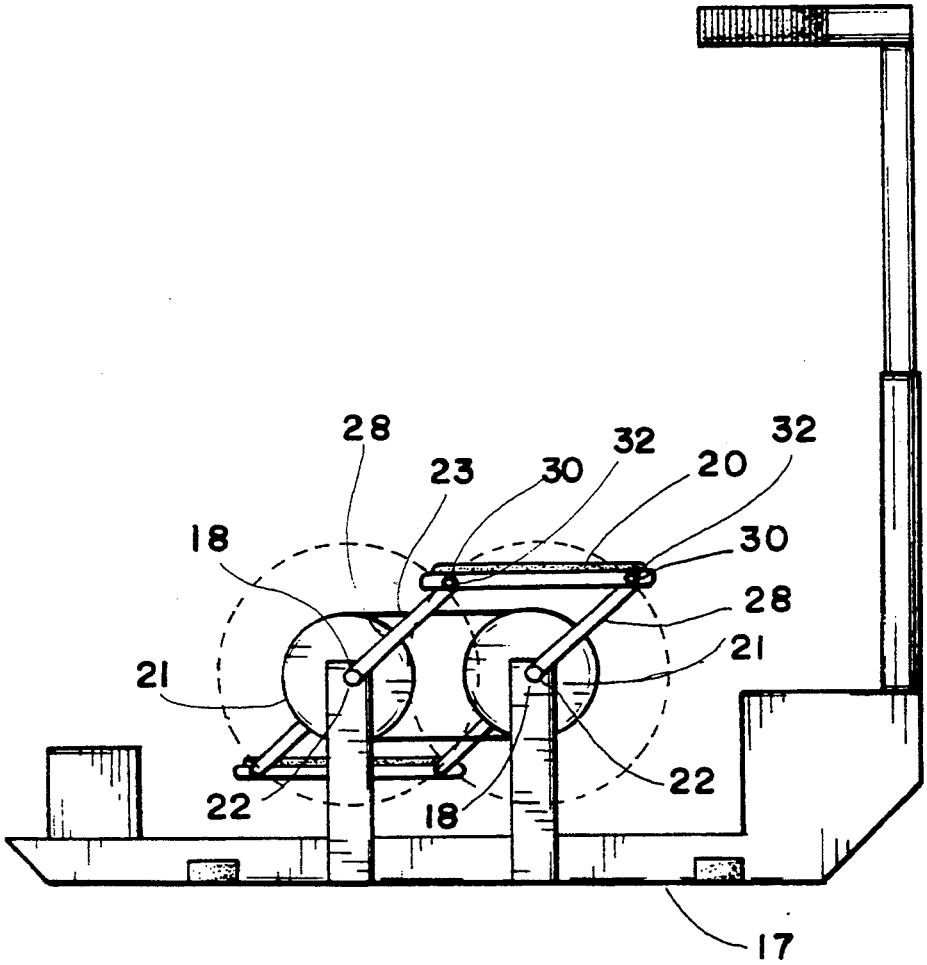
FIG. 5 is a side view of the frame structure means, rotation assembly means, and foot engagement means operating together, demonstrating the rotation path of the foot engagement means.

FIG. 5, along with the previous figures, demonstrates how the frame structure means, rotation assembly means, and foot engagement means operate together. As seen, rotatable members 21 are fixedly mounted on shaft members 22, with shaft members 22 rotatably coupled to base structure 17 through structure openings 18. Interconnection member 23 connects rotatable members 21. As also seen, first leg 28 of connection members 27 are attached to shaft members 22 as they extend past structure openings 18. They are fixedly attached at the same angle.

On the other side, the connection members 27 attach to the other ends of shaft members 22, but in the opposite direction from those on the previous side. On each side, foot engaging member 25 loosely receives the secong leg 30 of two connection members 27. Foot engaging member 25 is secured in place by bolt nut member 32. Since the connection members 27 are at the same angle, the foot engaging member 25 is initially at a substantially horizontal position and should remain so as long as the rotatable members 21 rotate with the same angular velocity and/or acceleration.

As seen, rotatable members 21 and the foot engaging members 25 will rotate in a curved path when force is either applied downward on the foot engaging member 25 by the foot of the user during manual operation, or motion is induced in rotation assembly means 12 by a motor means 15 during automatic operation. In examing one side of the apparatus, it can be seen that since the connection members 27 are at attached to shaft members 22 at the same angle and rotatable members 21 rotate at the same angular velocity and/or acceleration, foot engaging member 25 will remain in a substantailly horizontal position as it moves along its rotation path. In other words, the foot engagement members and the connection members are attached together along horizontal axes restricting relative movement to rotation about the axes. The foot engaging member 25 on the opposite side will also remain in a substantially horizontal position as it rotates about an identical rotation path. Movement will be in the opposite direction from the other foot engaging member 25, since the connection members 27 are attached to shaft members 22 at opposite angles. The foot engagement means may rotate in the forward or reverse path motion, as directed by the user or the motor.

Figure 6A:
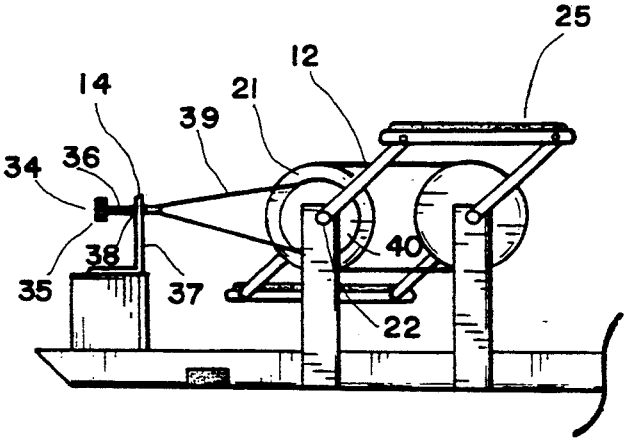
FIG. 6A is a side view of a resistance means operating in conjunction with the rotation assembly means.
Figure 6C:
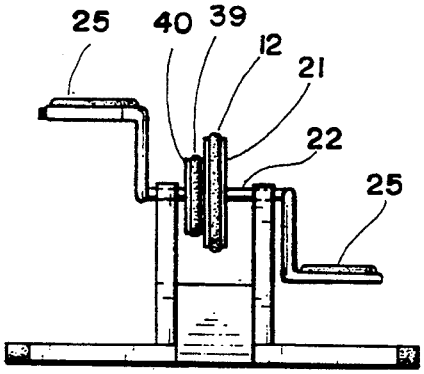
FIG. 6C is a front view of the resistance means in FIG. 6A.
Figure 6B:
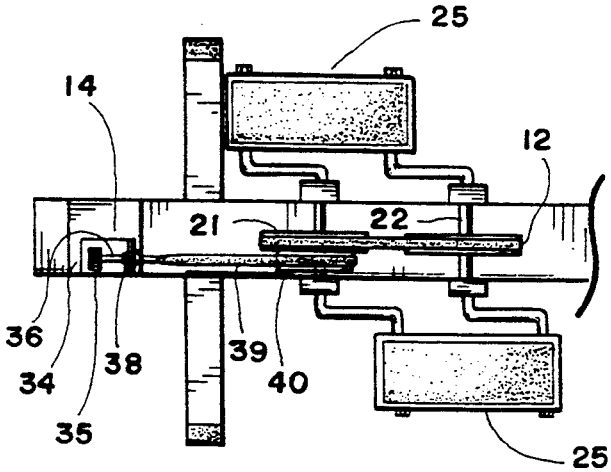
FIG. 6B is a top view of the resistance means in FIG. 6A.

As may be seen in FIGS. 6A, 6B, and 6C, a resistance means 14 may be utilized by the rotational assembly means 12 to provide a resistance to motion in the rotatable members 21, and therefore a resistance to motion in the foot engagement means 13. Many different types of resistance means currently exist which may be utilized with this apparatus. It is to be undestood that the resistance means called for in this specification is for demonstration purposes only. This resistance system consist of an endless friction belt 39 which extends around at least a portion of the periphery of circular member 40. Circular member 40 is fixedly mounted on the same shaft member 22 as one of the rotatable members 21, and rotates in conjunction with that member. The tension on friction belt 39 is adjusted by tension adjustment means 34, which consist of threaded shaft 36 and hand operated knob 35. Tension adjustment means 34 mounts through tension mount 37. Tension mount 37 has a threaded opening 38 which receives threaded shaft 36. The friction belt 22 loosely connects to threaded shaft 36 so that turning the hand operated knob 35 does not cause the belt to twist, and the friction belt does not rotate as circular member 40 rotates. As the hand operated knob 35 is turned in one direction, the threaded shaft 36 turns in threaded opening 38, threaded shaft 36 moves backward, causing friction belt 39 to tightened against the circular member 40. This tightening produces a resistance to motion in rotatable members 21 and foot engaging members 25. Turning hand operated knob 35 in the opposite direction will loosen the friction belt 39 and therefore reduce the amount of resistance.

Figure 7A:
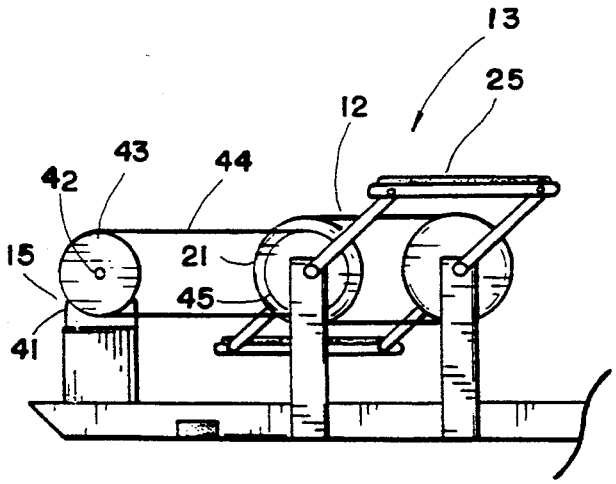
FIG. 7A is a side view of a motor means operating in conjunction with the rotation assembly means.
Figure 7C:
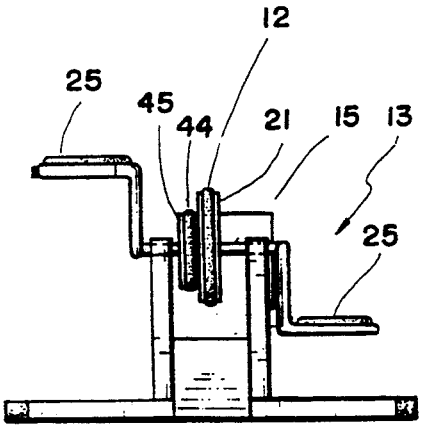
FIG. 7C is a front view of the motor means in FIG. 7A.
Figure 7B:
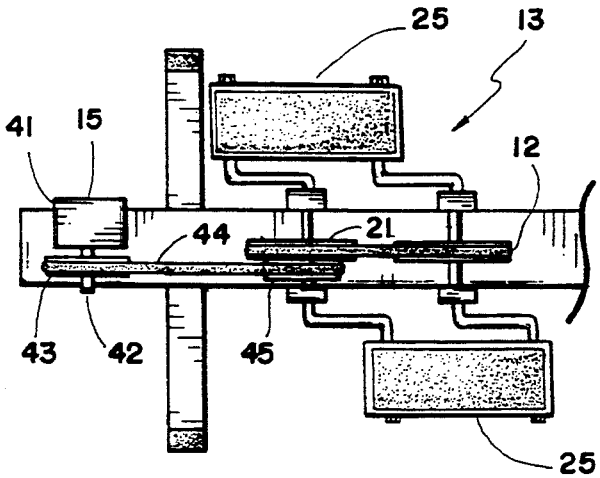
FIG. 7B is a top view of the motor means in FIG. 7A.

FIGS. 7A–7C demonstrate a typical motor means 15 which may be utilized by the rotation assembly means 12, during automatic device operation, for producing rotation in foot engagement means 13. The motor means 15 consist of a motor 41 which has a shaft rotatable member 43 fixedly mounted on motor shaft member 42. A motor rotatable member 45 is fixedly mounted on the shaft member 22 of at least one of the rotatable members 21. An interconnection means 44 is used to connect motor shaft member 42 and motor rotatable member 45. As the motor shaft turns, so will shaft rotatable members 43, which causes motor rotatable member 45 to rotate, and therefore rotatable members 21 to rotate. This in turn causes foot engaging member 25 to rotate around its path of rotation. Again, this setup is for demonstration purposes only, since many variations may be utilized to produce the same result. The simplest and easiest setup to understand would be a basic sprocket and chain assembly.

Figure 8A:
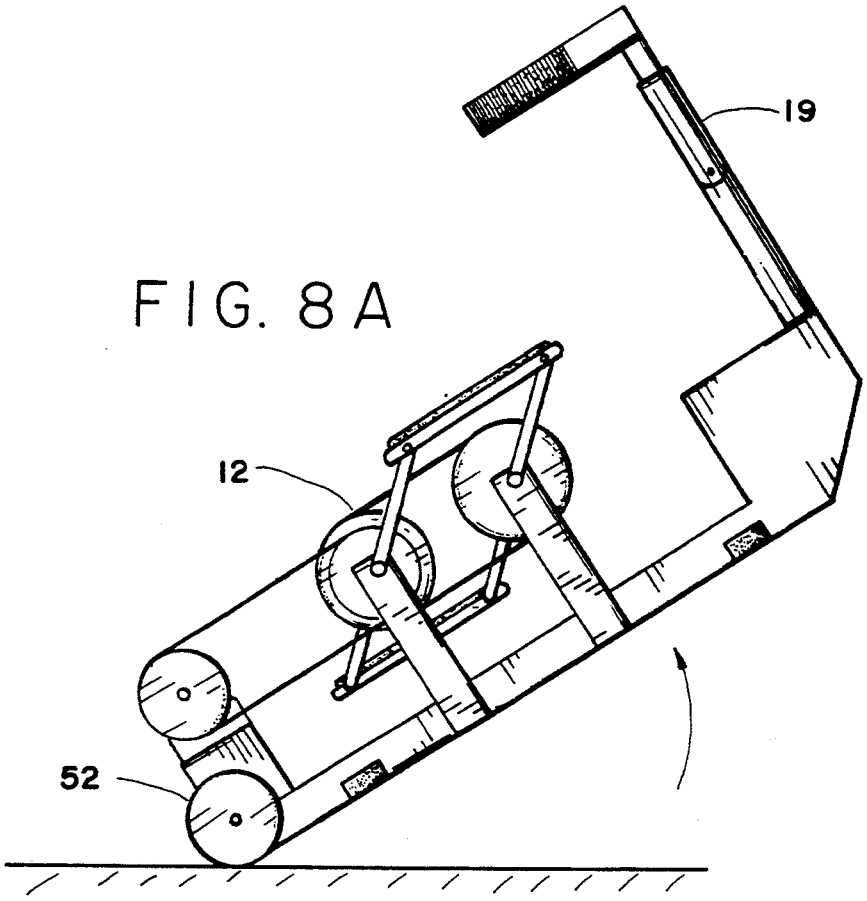
FIG. 8A is a side view of a collapsing handle member with an added wheel attachment for easy relocation and/or storage of apparatus.
Figure 8B:
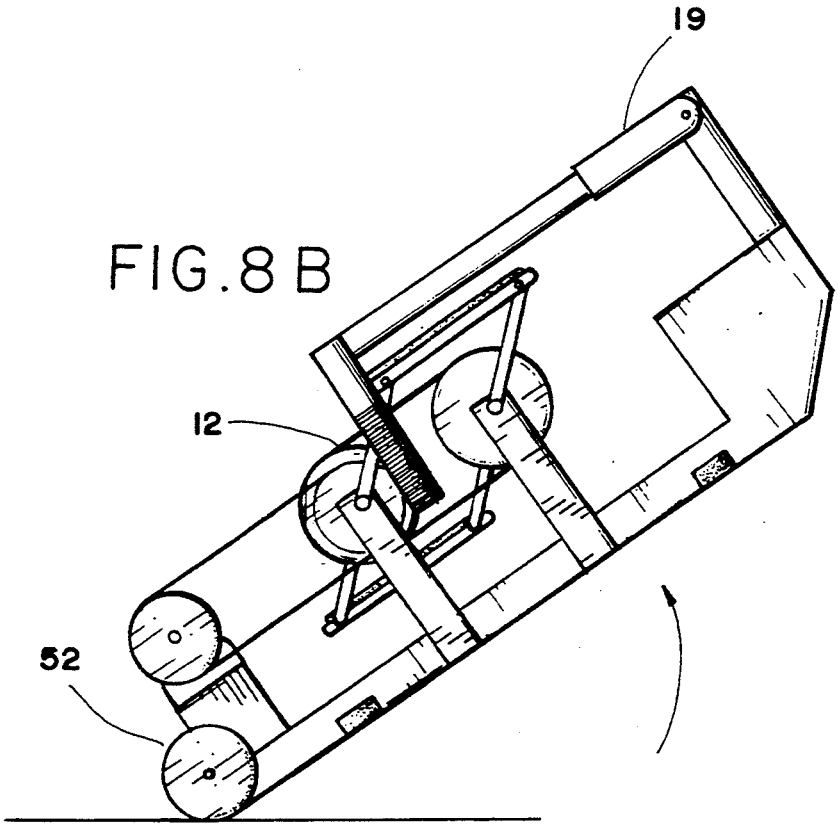
FIG. 8B is a side view of another type of collapsing handle member with added wheel attachments for easy relocation and/or storage of apparatus.
Figure 9A:
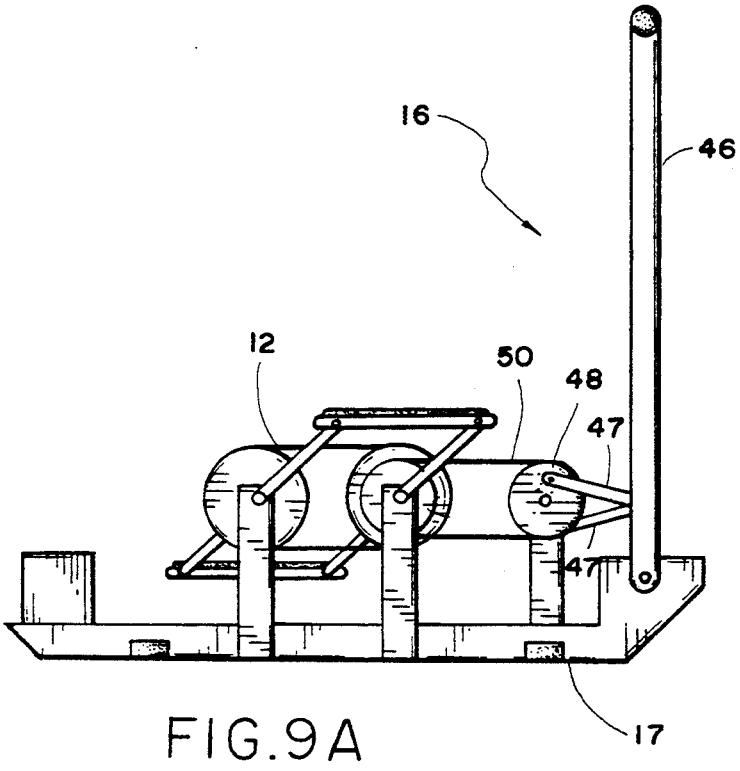
FIG. 9A is a side view of the stationary exercise apparatus with an added upper body workout means.
Figure 9C:
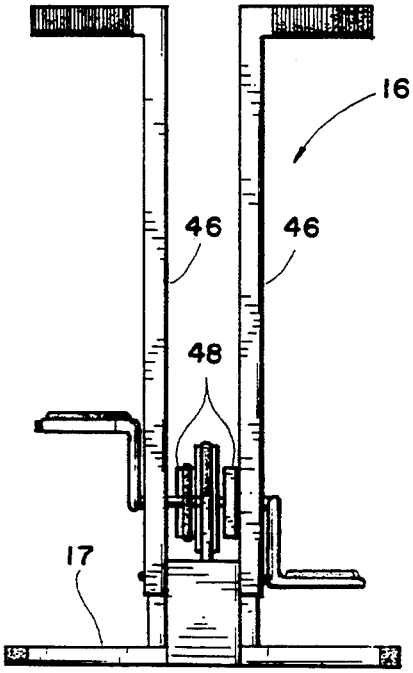
FIG. 9C is a front view of the apparatus in FIG. 9A.
Figure 9B:
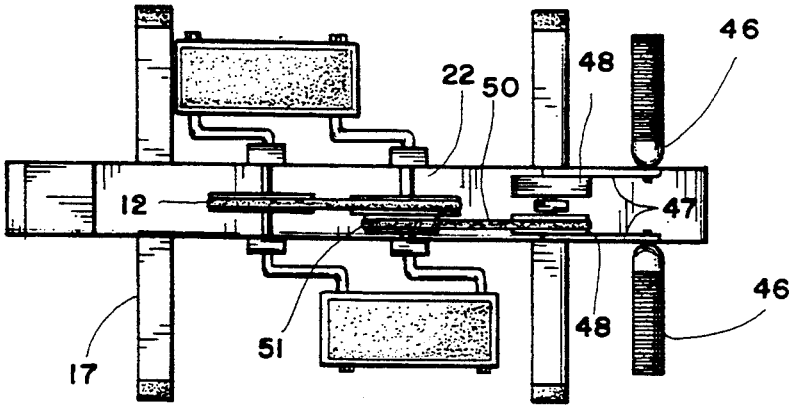
FIG. 9B is a top view of the apparatus in FIG. 9A.
Figure 9D:
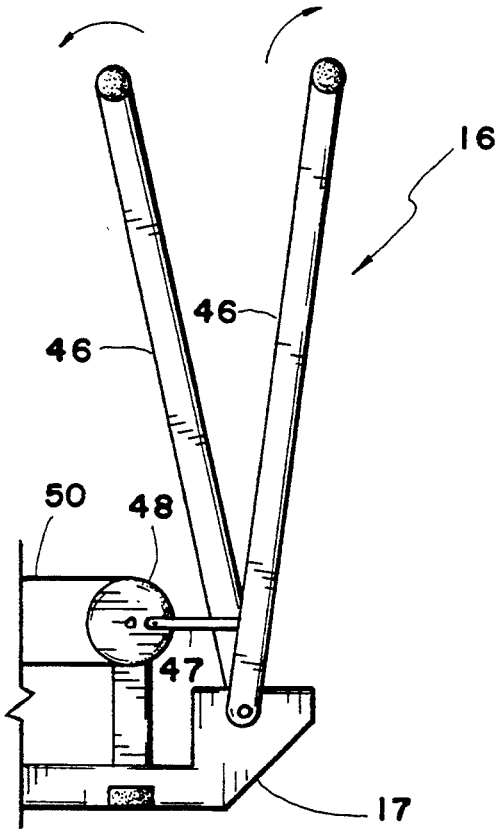
FIG. 9D is a side view of the apparatus in FIG. 9A, demonstrating the rocking feature of the hand engagement members.
Figure 9E:
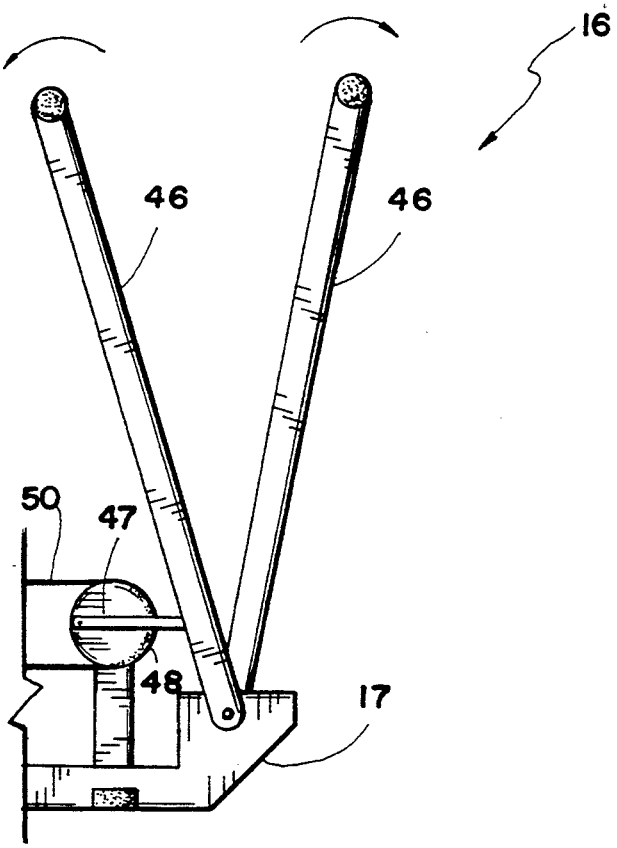
FIG. 9E is a side view of the apparatus in FIG. 9A, also demonstrating the rocking feature of the hand engagement members.

As may be seen in FIGS. 8A and 8B, the frame structure means may be collapsed into a more compact configuration for easier storage and relocation. In FIG. 8A, handle member 19 may be substantially lowered to reduce overall heigth. FIG. 8B shows handle member 19 may be folded over to a lower position, which also reduces overall heigth. A collapseable handle member 19 may also be designed which combines both features, the ability to be lowered and the ability to fold over. Also included is typical wheel assembly 52 mounted on at least one end of base structure 17, preferrable the heavier end. This enables the apparatus to be lifted by the other end and pushed or pulled to a different location. Wheel assembly 52 is a basic wheel and axis assembly, with at least one wheel.

FIG. 9A thru 9E demonstrate an upper body workout means 16 which may be used in conjunction with rotation assembly means 12. Upper body workout means 16 is a widely recognizeable assembly that is presently used in a many stationary exercise devices, including cycles, treadmills, stair-steppers, and skiing or gliding devices. It consist of two hand engageable members 46, rotatable coupled to base structure 17, and each connected to motion transfer rotatable members 48 by coupling members 47. The connection is such that rotation in motion transfer rotatable members 48 will result in back and forth rocking motion of hand engageable members 46, in opposite direction from one another. Rotation is produced in motion transfer rotatable members 48 by rotation assembly means 12, and vice versa. An assembly rotatable member 51 is fixedly mounted on the shaft member 22 of one of the rotatable members 21. Rotation of rotatable member 21, by either automatic or manual means, will produce rotation in assembly rotatable member 51. Assembly rotatable member 51 is connected to at least one of motion transfer rotatable members 48 by interconnection means 50. Therefore, rotation in the rotation assembly means 12 will cause hand engageable members 46 to rock back and forth in opposite direction, and vice versa.

During manual operation, hand engageable members 46 can be used by the user in conjunction with foot engagement means 13 to overcome resistance forces exerted by resistance means 14. During automatic operation, hand engageable members 46 will rock back and forth as directed by the motor means 15.

Hand engageable members 46 may also be adjustable for different user heigths similar to that shown in FIG. 2D. They may also be adjustable for different grasping widths, in a similar manner to FIG. 2E, but in an inward and outward direction as opposed to backward and forward direction. The upper body workout means may also be collapseable into a more compact form, similar to FIGS. 8A and 8B.

The hand engageable members may have a telescoping feature, a folding feature, or both, to substantially reduce overall heigth. A third feature may be the ability to disconnect the hand engageable members from motion transfer rotatable members 51 and fold them downward over or beside rotation assembly means 12 to substantially reduce overall heigth. In any case wheel assembly 52 may be added to assist in storage and relocation, as previously explained.

While it will be apparent that the preferred embodiment of the invention herein disclosed is well-calculated to fulfill the objects above stated, it will be appreciated that the invention is susceptible to modification, variation, and change without departing from the proper scope or fair meaning of the subjoined claims.

I claim:

1. A stationary exercise apparatus comprising:

a frame structure;

a rotation assembly mounted on said frame structure, wherein said rotation assembly includes at least two rotatable members, said rotatable members being connected together by a closed loop interconnection means such that said rotatable members rotate at the same angular velocity and acceleration; and foot engagement means connected to said rotation assembly, wherein said foot engagement means includes connection members and two foot engaging members, each of said foot engaging members being connected to one side of each of said rotatable members through said connection members such that both foot engaging members remain in a substantially horizontal position as the rotatable members rotate, said foot engagement members and said connection members being attached together along horizontal axes restricting relative movement to rotation about said axes;

whereby a user may perform a cycling routine while in a standing position.

2. A stationary exercise apparatus according to claim 1, wherein said frame structure includes a handle member.

3. A stationary exercise apparatus according to claim 2, wherein said handle member is upward and downward adjustable.

4. A stationary exercise apparatus according to claim 3, wherein said handle member is backward and forward adjustable.

5. A stationary exercise apparatus according to claim 1, wherein said rotatable members and said interconnection means together comprise a sprockets and chain assembly.

6. A stationary exercise apparatus according to claim 5, wherein each of said foot engaging members comprises a substantially flat top surface and sleeve openings spaced along a side surface to receive said connection members, and each of said connection members is a substantially L-shaped rod having a first and second leg, said first leg including means for rigid attachment to one of said rotatable members, and said second leg including means for attachment with one degree of rotational freedom to one of said foot engaging members.

* * * * *